US005582028A

United States Patent [19]

Rilling et al.

[11] Patent Number: 5,582,028

[45] Date of Patent: Dec. 10, 1996

[54] FOLDABLE ADJUSTABLE COOLING PACK

[76] Inventors: Kim Rilling, 1353 Glenmare St., Salt Lake City, Utah 84105; Garff B. Collard, 1930 Capistrano St., San Diego, Calif. 92106

[21] Appl. No.: 391,052

[22] Filed: Feb. 21, 1995

[51] Int. Cl.[6] ..... F25D 3/08

[52] U.S. Cl. ..... 62/530; 62/457.4; 62/457.5

[58] Field of Search ..... 62/529, 530, 457.2, 62/457.5, 457.4, 371

[56] References Cited

U.S. PATENT DOCUMENTS

| | | | |
|---|---|---|---|
| 1,696,138 | 12/1928 | Day et al. | 62/530 |
| 1,741,377 | 12/1929 | Scarlett | 62/530 |
| 3,262,283 | 7/1966 | Taylor | 62/457.5 |
| 4,324,111 | 4/1982 | Edwards | 62/457.4 |
| 4,399,668 | 8/1983 | Williamson | 62/457.4 |
| 4,413,481 | 11/1983 | Thomas | 62/371 |
| 4,498,312 | 2/1985 | Schlosser | 62/457.2 |
| 4,831,842 | 5/1989 | Kelley et al. | 62/457.4 |
| 4,858,444 | 8/1989 | Scott | 62/372 |
| 5,005,374 | 4/1991 | Spitler | 62/259.3 |
| 5,237,838 | 8/1993 | Merritt-Munson | 62/457.2 |

*Primary Examiner*—William Doerrler

*Attorney, Agent, or Firm*—Lloyd W. Sadler; Daniel P. McCarthy; Jon C. Christiansen

[57] ABSTRACT

A cooling pack for cooling and keeping cool beverages and other containerized food products. The cooling pack is designed to fit closely around the container and is adjustable to fit around a variety of containers. The cooling pack is also designed to be foldably compact, when not in use or for freezing. The cooling pack is made of an insulating yet flexible material, the exterior of which is ideal for printing commercial or other symbols upon. The cooling pack also includes a convenient strap for carrying the loaded cooling pack in a secure manner.

17 Claims, 6 Drawing Sheets

FOLDABLE ADJUSTABLE COOLING PACK

BACKGROUND OF THE INVENTION

A. Field of the Invention.

The invention relates to the field of devices used in cooling or maintaining the low temperature of food products. The invention is particularly useful in that it is adjustable, permitting the user to fit the device around a variety of container shapes, and in that it is foldable, so that it requires very little storage space when it is empty. In the preferred embodiment, the invention is intended to be used to carry and keep cool canned or bottled beverages. The invention is formed with a number of panels, each of which may be composed of cooling chambers containing a freezable gel and which can be fixed adjacent to a container by means of adjustable straps. When the invention is not in use, or is in the process of being cooled or frozen itself, it can be folded into a small volume, thereby taking up less space for carrying or storage.

B. Description of Related Art.

In the related art, there are various types of coolers or containers for keeping items cool. Existing coolers do not have the combination of features which constitute this invention. Existing coolers are either fixed into a solid inflexible form, not suited to folding; are designed to fit around a particular shaped container and thus not reconfigurable; or they are not a complete device for use as a stand alone cooler. For examples of such related art devices, the reader is directed to U.S. Pat. Nos. 4,324,111, 4,399,668, 4,413,481, 4,831,842 and 4,986,089, each of which is hereby incorporated by reference.

The advantages of this new invention over existing devices are that the invention is designed to be reconfigurable such that it can fit snugly around a wide range of different containers; it is foldable such that when it is not in use it requires significantly less space by volume than when it is in use, thus being convenient to store; and it is a self-contained complete unit that includes all of the structural components necessary to hold, support, and carry the container to be cooled.

SUMMARY OF THE INVENTION

It is an object of this invention to provide a cooler device for cooling containerized food or beverage products. It is a feature of the invention that compartments designed to accommodate freezable gel are included to provide a cooling mechanism. It is an advantage of the invention that the coolant (freezable gel) is kept in very close proximity to the food item being cooled.

It is an object of this invention to provide a cooler device for cooling containerized food or beverage products, that is adjustable and reconfigurable to fit a variety of different containers. It is a feature of the invention that it is both foldable and adjustable to accommodate folding around containers of various shapes. It is an advantage of the invention that it is not designed to fold around only a container of a predetermined shape.

It is an object of the invention to provide a cooler device for cooling containerized food or beverage products, that, when not it use, can be folded to require much less volume for storage than for use. It is a feature of the invention that its structure permits ready folding into a compact unit for storage. It is an advantage of the invention that the folded unit can be placed into a low volume space for storage or transport, such as into a jacket pocket.

It is an object of this invention to provide a cooler device for cooling containerized food or beverage products, that utilizes a freezable gel held within pockets in panels of the device. It is a feature of the invention that such pockets capable of holding a freezable gel are provided. It is an advantage of this invention that loose coolant pouches, which are difficult to manage, are not emphased.

It is an object of this invention to provide a cooler device for cooling containerized food or beverage products, that does not require the use of ice or other disposable refrigerants. It is a feature of the invention that self contained reusable freezable gel is used to provide the means of cooling the food or beverage product. It is an advantage of the invention that leaking and spilling of the refrigerant is avoided.

It is an object of this invention to provide a cooler device for cooling containerized food or beverage products, that is light weight. It is a feature of the invention that it is not burdensome to carry either alone or in combination with the food or beverage product. It is an advantage of the invention that it is easily transportable on the person of the user of the invention.

It is an object of this invention to provide a cooler device for cooling containerized food or beverage products, that incorporates a carrier for the product container. It is a feature of the invention that carrying straps or handles are provided. It is an advantage of the invention that containers placed within the invention are more easily carried by the user of the invention.

It is an object of this invention to provide a cooler device for cooling containerized food or beverage products, that incorporates temperature insulating side panels. It is a feature of the invention that insulating side panels are provided to fit around the otherwise exposed portions of the product container. It is an advantage of the invention that food and beverage products held within the invention will stay cool longer because of the temperature insulating properties of the invention side panels. It is another advantage of the invention that food and beverage products will be cooled by being held within the invention because of the use of the freezable gel held within the side pockets and in some embodiments in the side panels.

It is an object of this invention to provide a cooler device for cooling containerized food or beverage products, that can be used as a foldable cooling lunch box. It is a feature of the invention that it can be folded into a general box shape suitable for carrying food products. It is an advantage of the invention that it has the carrying and storage properties of a lunch box along with the cooling properties of a cooler as well as being foldable and compressible such that it requires less space when empty.

Additional objects, features and advantages of the invention will be observed by persons of ordinary skill in the art upon reading the appended description and referring to the appended drawings.

DETAILED DESCRIPTION OF THE INVENTION

The invention is a cooling pack for use in cooling or keeping cool containerized food products and beverages. Cooling is defined, for the purposes of this disclosure, as either reducing the temperature or maintaining a temperature below room temperature. The preferred embodiment of the invention comprises a foldable covered rectangular panel, sized to wrap around a container the size of a six-pack of canned beverages. The invention also accommodates folding sections to wrap around a container the size of a two-liter or smaller bottle; two attachable insulating panels to fit over otherwise exposed ends of the container; a number of pockets attached by means of a sewing process to one surface of the panel; a number of enveloped refreezable gel units; a hook and loop type fastener; and a strap. The two attachable insulating panels, whose primary use is to provide a means of insulating or cooling the otherwise exposed ends of a container, may, in the alternative, be wrapped around single beverage size cans, to insulate or cool an individual food or beverage product.

Figure 1:
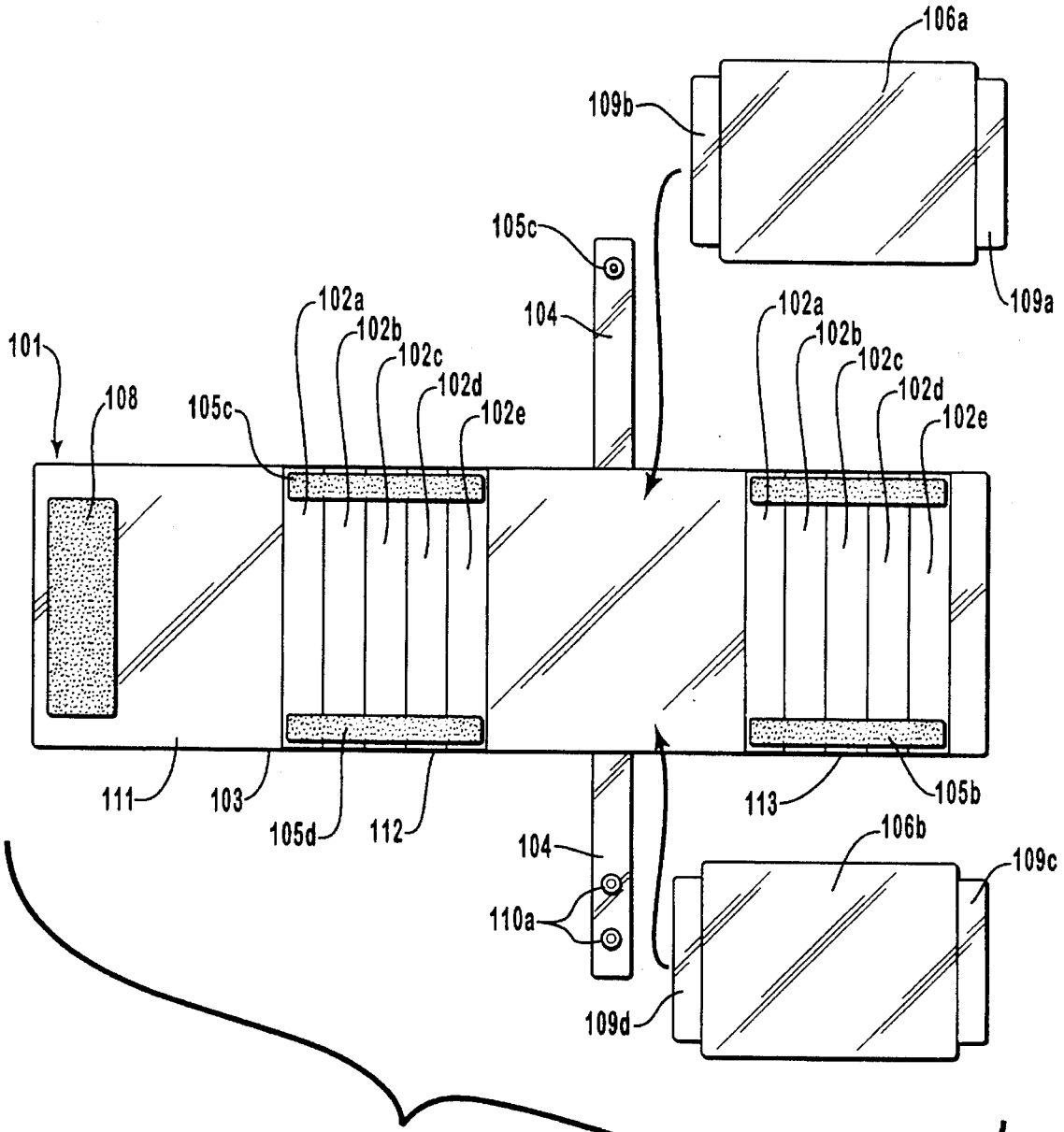
FIG. 1 depicts the first side of the invented cooling pack in a fully unfolded condition.

FIG. 1 shows the invented cooling pack 101, laid out flat, prior to the rectangularly shaped insulating panel 103 of the cooling pack 101 being wrapped around a food or beverage container. In the preferred embodiment of the invention the rectangularly shaped insulating panel 103 is composed of a fabric material. However, other suitable materials exist for use in the insulating panel 103, including: fabric covered foam rubber, plastic, fabric layers with an internal metalized milar lining, plastic wrapped foam rubber and others. The cooling pack 101 includes a plurality of pockets **102*a* through 102*j* each of which is adapted to hold a quantity of freezable gel. In the preferred embodiment of the invention these pockets 102*a* through 102*j* are made of either fabric or vinyl, however, other materials including plastic would also be suitable. The pockets 102*a*–102*j* are shown running across the width of the rectangularly shaped insulating panel 103 in two separate groups. The first group is defined as pockets 102*a*–102*e* and the second group is defined as pockets 102*f*–102*j*. The first group 102*a*–102*e* is located on the insulating panel 103 in a position which will become the cooling pack 101 first wall 112 when the insulating panel 103 is folded around a six pack or other similarly shaped object. The second group 102*f*–102*j* is located on the insulating panel 103 in a position which will become the cooling pack 101 second wall 113 when the insulating panel is folded around a six pack or other similarly shaped object. In the current preferred embodiment these pockets 102*a* through 102*j* are attached to the insulating panel 103 by a sewing means. Other ways of attaching the pockets 102*a* to 102*j* to the insulating panel 103** include glue and making the pockets out of loops of fabric used in the covering of the insulating panel, as well as other suitable methods. The current preferred embodiment of the invention uses ten pockets for holding the freezable gel. Each pocket is approximately an inch in width and approximately 8 inches long. However, alternative numbers of pockets as well as sizes and shapes are possible for use in other enablements of this invention.

Between the first and the second groups of pockets, there exists a section of the insulating panel 103 referred to as a cooled container receptacle 107 which is of a dimension of sufficient size to accommodate the placement of a traditional six-pack of beverage cans or a six-pack of bottles thereon. In an alternative embodiment of the invention, the container receptacle 107 would include one or more pockets adapted to contain freezable gel.

The end of the insulating panel nearest the freezable gel pocket **102*a* is the top portion 111. This top portion 111 is so described because when the insulating panel 103 is folded to fit around a six-pack or other similarly shaped object the top portion 111 will be situated on the top of the six-pack, and folded over the side of the second insulating panel 113. This top portion 111** may be composed of fabric, insulating foam, pockets of freezable gel and or any other material that lends itself to the purpose of providing structural support and an insulating or cooling means.

The cooling pack 101 also includes a fastener 108 and 201. The fastener 108 is attached to the insulating panel 103 in the vicinity of the top portion 111. The preferred fastener 108 includes hook and loop fastening means, although the fastener 108 could include any fastening mechanism, such as snaps, buttons, a zipper, straps or belts with buckles, magnetic fastening means or other fastening means.

A carrying and support strap 104 is shown attached underneath the insulating panel 103 and running across the width of the panel 103. This strap 104 is attached, in the preferred embodiment, on the reverse side of the container receptacle 107 using a belt loop means of attachment. Other possible attachment means could be employed including: an integrated cavity running within container receptacle 107 with openings on each side of the container receptacle 107; a sewing means whereby the strap is sown directly on the container receptacle 107; a multiple snap connector means; and any other alternative means of attaching a strap to a fixed panel. The strap 104 can be joined end 111 to end 112 to form a carrying strap. In the preferred embodiment the means of joining the ends 111 and 112 of the strap are through the use of snaps **110*a* and 110*b*. Other alternative methods of joining the ends 111 and 112 of the strap 104** together to form a carrying strap include hook and loop means, buttons, a buckle, and other equivalent means.

Also shown in FIG. 1 are two additional insulating panels **106*a* and 106*b* designed to abut against the ends of a container placed into the container receptacle 107 to insulate the ends of such container which would otherwise lack insulation. In the current embodiment of these insulating panels, 106*a* and 106*b*, they are composed of fabric covered foam rubber. Optionally, the additional insulating panels 106*a* and 106*b* may include pockets and freezable gel to provide additional cooling to the container being insulated and cooled. In the preferred embodiment of the invention, the additional insulating panels 106*a* and 106*b* attach to the cooling pack 101 by a hook and loop fastening means 105 and 109, although the panels could be attached through any fastening means, such as snaps, buttons, zipper, straps or belts, magnetic attachment means or other attachment means. These insulating panels, 106***a* and 106*b*, are designed such that they can be detached from the cooling pack and used as cooling wraps for individual cans.

Figure 2:
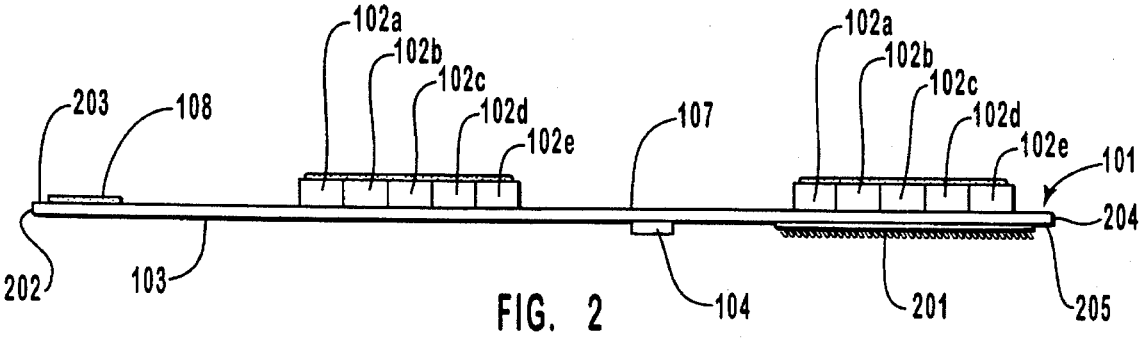
FIG. 2 depicts a side view of the invented cooling pack in a fully unfolded condition.

FIG. 2 shows a side view of the cooling pack 101. The two sections of pockets 102*a*–102*e* and 102*f*–102*j*, the container receptacle 107, the insulating panel 103 and the strap 104 are seen in this side view. Both components of the fastener means 108 and 201 are shown. Since the use of the cooling pack 101 involves wrapping or folding it around the item to be cooled and fixing it in place through this fastening means, the first component of the fastener 108 is located on or near the first end 202 of the insulating panel 103 on the interior side 203 with the second component 201 located on or near the second end 204 of the insulating panel 103 on the exterior side 205. The second fastener component 201 is designed to be wider than the first fastener component 108, so as to accommodate a variety of container sizes. In the preferred embodiment of the invention this fastening means is a hook and loop means, and closure is accomplished by contact between the first component 108 and the second component 201. In alternative embodiments, the position or specific means employed of fastener may be changed to fit the type of product to be held and kept cool.

Figure 3:
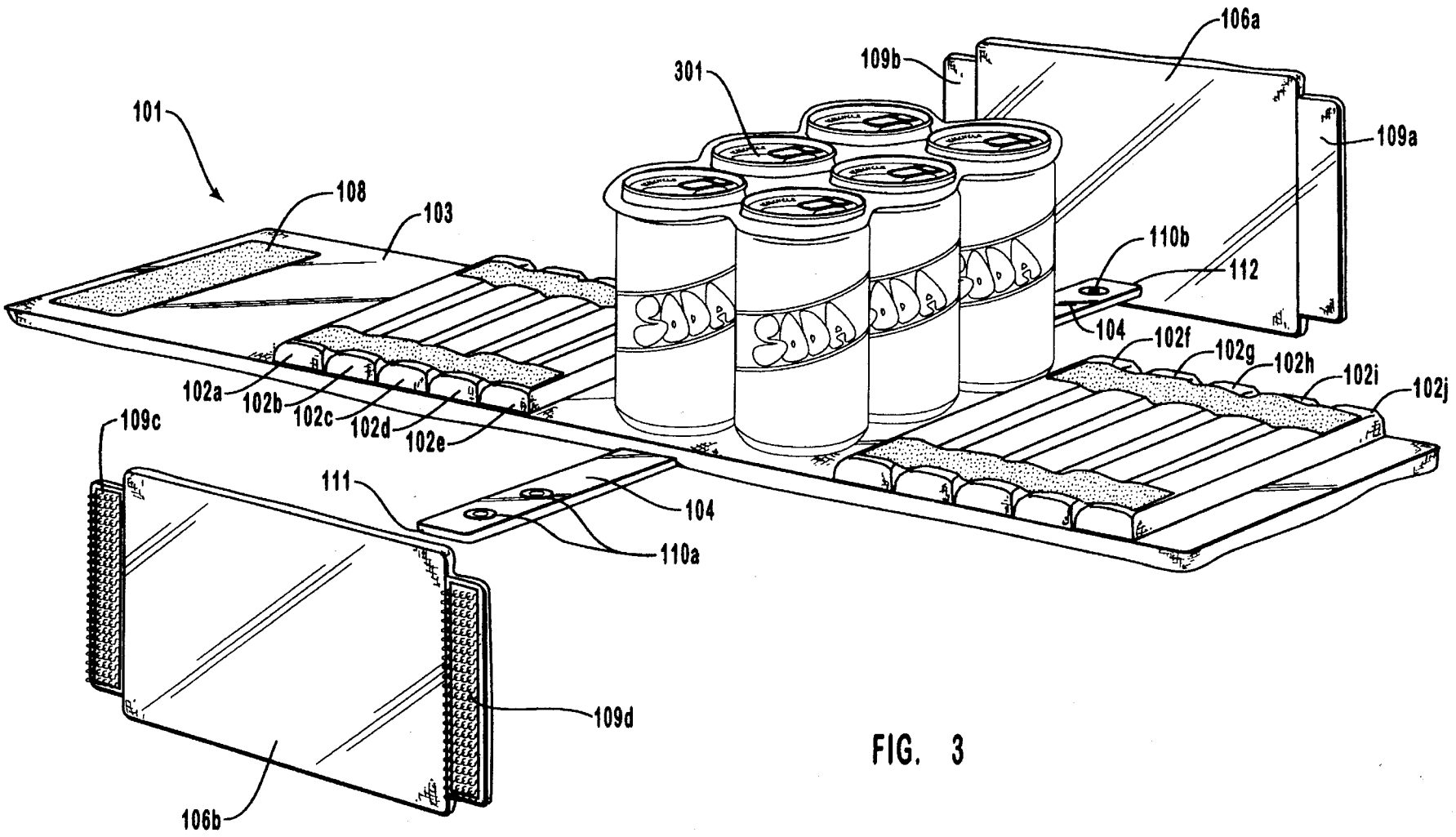
FIG. 3 depicts the cooling pack invention with a six-pack of canned beverages placed in a location in preparation to folding the cooling pack around the canned beverages for cooling.

FIG. 3 is a perspective view of the cooling pack 101 with a six pack of canned beverages 301 positioned on the container receptacle 107 in preparation to being enclosed by the cooling pack. It can be seen from this Figure that when the cooling pack 101 is folded about the six pack 301, the pockets 102*a*–102*e* containing freezable gel will form a first wall which abuts the first side of the six pack 301, thereby providing cooling and insulation to said first side of the six pack 301. It can also be seen from this Figure that when the cooling pack 101 is folded about the six pack 301, the pockets 102*f*–102*j* containing freezable gel will form a second wall which abuts the second side of the six pack 301, thereby providing cooling and insulation to said first side of the six pack 301. The portion of the insulating panel 103 which serves as the container receptacle 107 will provide insulation to the bottom of the six pack 301 and will optionally also provide cooling to the six pack 301 by having a pocket or pockets with freezable gel therein. It is also apparent from this Figure that the additional insulating panels 106*a* and 106*b* are designed to abut against the first and second ends respectively of the six pack 301 to insulate it. Optionally the additional insulating panels 106*a* and 106*b* may have pockets containing freezable gel to further cool the six pack 301.

Figure 4:
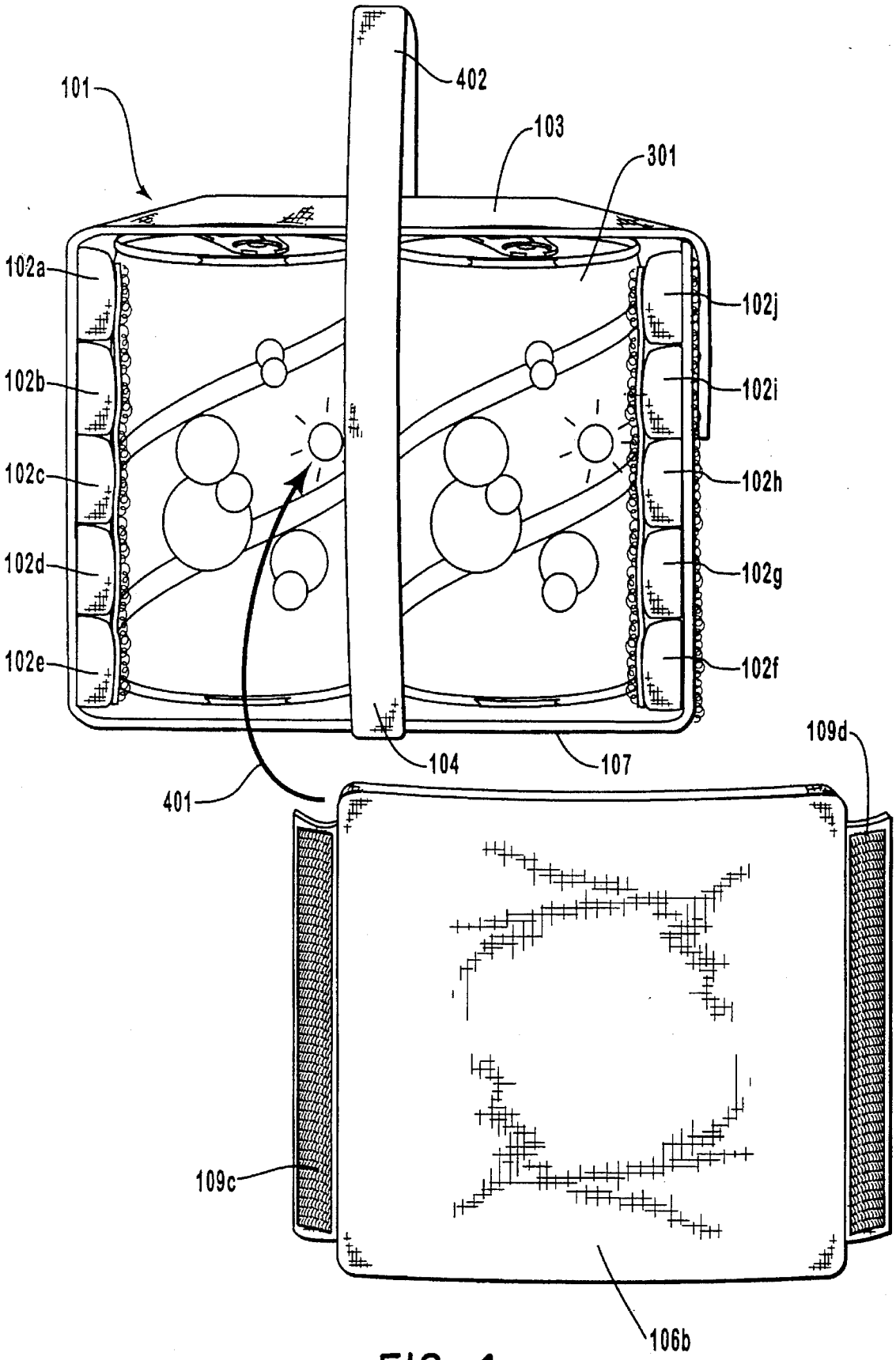
FIG. 4 depicts a side view of the cooling pack invention after it has been folded around a six-pack of canned beverages and before insulating panels are attached.

FIG. 4 depicts the cooling pack 101 having been wrapped around the six pack 301, held in place by use of the strap 104 which in the preferred embodiment includes snaps as a fastening means. The strap 104 is a flexible elongate piece of nylon web attached to the insulating panel 103 so that a substantial length of the strap 104 protrudes from each side of the insulating panel 104 for wrapping about the six pack 301 in a direction transverse to the length of the insulating panel 103 in order to form a handle 402 at the top of the six pack 301 to permit easy carrying of the six pack 301. Also shown in FIG. 4 by arrow 401 is the placement of the additional insulating panel 106*b* against the second end of the six pack 301 in order to insulate it. The strap 104 firmly retains the additional insulating panel 106*b* against the second end of the six pack 301 because the strap 104 would be wrapped about the exterior of the additional insulating panel 106*b*, the additional insulating panel 106*b* being located between the six pack 301 and the strap 104.

Figure 5:
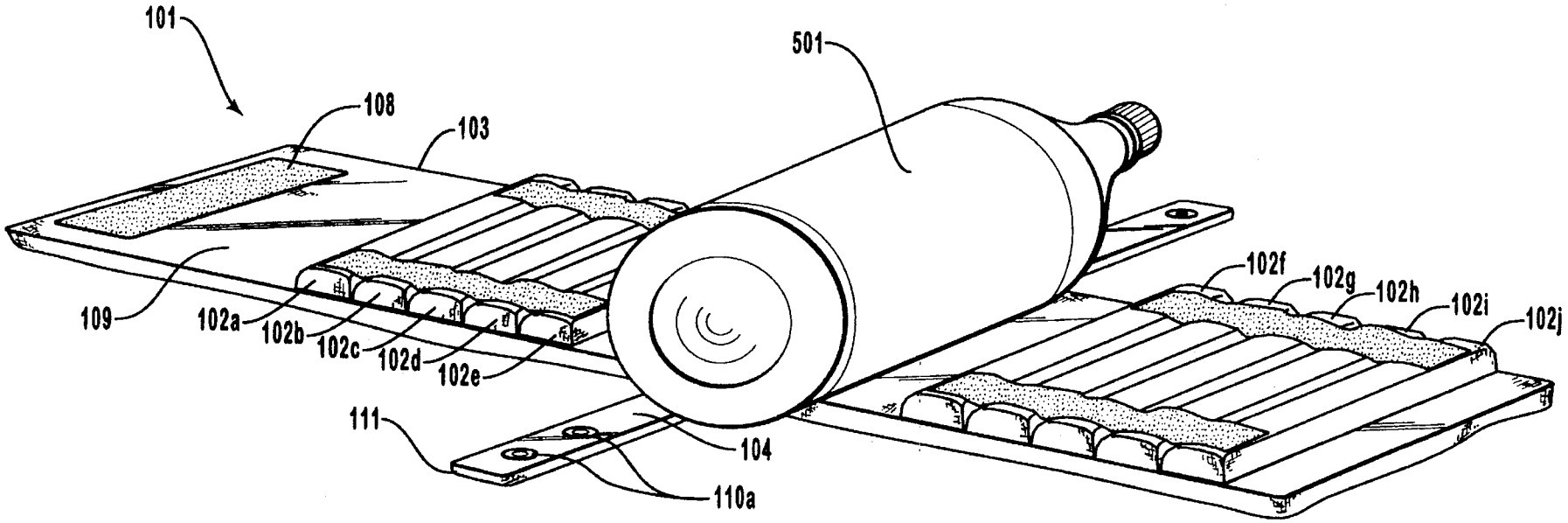
FIG. 5 depicts the cooling pack invention with a single bottled beverage placed thereon in preparation for folding the cooling pack around the bottle for cooling.

FIG. 5 shows the cooling pack 101 with a single beverage bottle 501 (such as a wine bottle) positioned in preparation to being enclosed by the cooling pack 101. Wrapping the cooling pack 101 around the bottle 501 is accomplished by placing the bottle 501 on the cooled container receptacle 107 traverse to the length of the insulating panel 103. Next, the area of the cooling pack 101 which would compose the second wall 113 is wrapped up and around the bottle 501. Next, the area of the cooling pack 101 which would compose the top 111 is wrapped up and around the bottle 501 as well as the second wall 113. The wrapping of the cooling pack 101 is accomplished in such a way as it fits tightly around the bottle 501 and is positioned such that first fastener component 108 comes in contact with second fastener component 201. Next, strap 104 is positioned to run across the bottom of the bottle 501 and up the side of the wrapped cooling pack 101 and to come in contact with the other end of strap 104. Once the two ends of strap 104 are brought together, they are fixed together to form a carrying handle 603, using strap joining means 110*a* and 110*b*.

Figure 6:
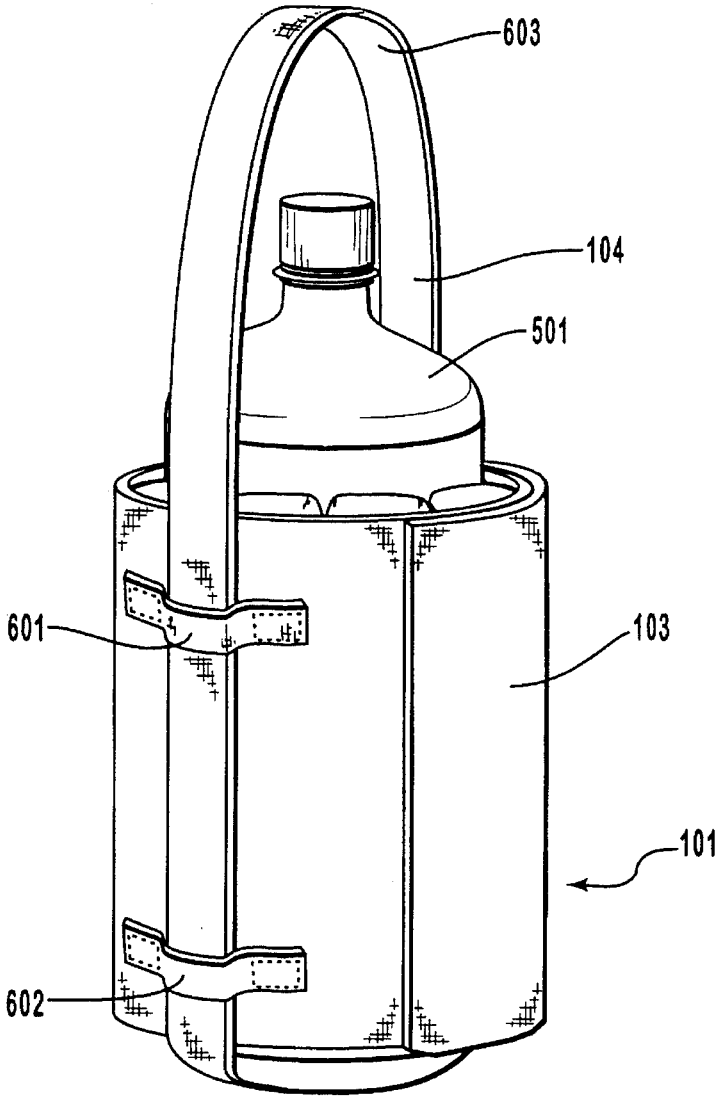
FIG. 6 depicts the cooling pack invention with a single bottled beverage placed inside the folded cooling pack for cooling.

FIG. 6 shows the cooling pack 101 having been wrapped around the single beverage bottle 501 of the previous figure. The cooling pack 101 is fastened about the bottle 501 and to itself through the use of the fastener components 108 and 201 and the fastening strap 104. The strap 104 is shown being held to the insulating panel 103 by the use of belt loops 601 and 602. The carrying strap 603 is shown formed by fixing together the two ends of the strap 104.

Figure 7:
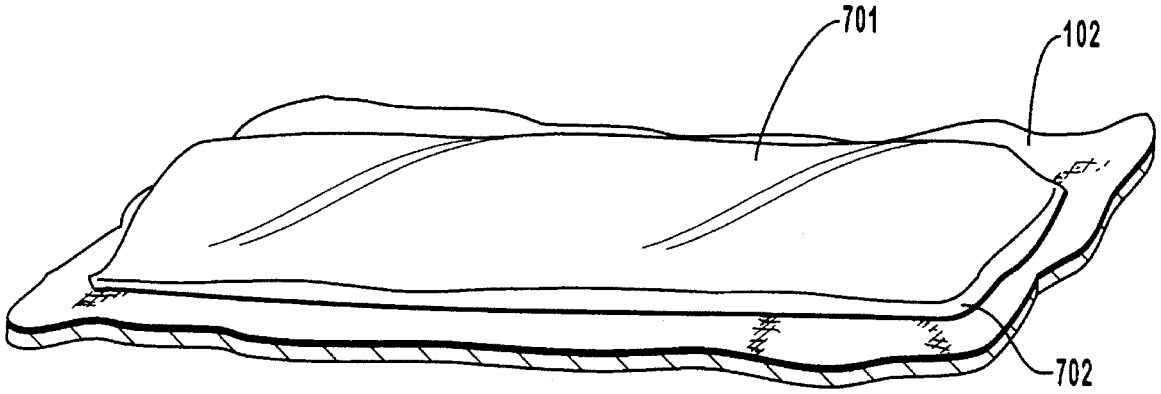
FIG. 7 depicts a cutaway view of a single refreezable gel filled pocket of the invented cooling pack.

FIG. 7 shows a cutaway view of a single refreezable gel filled pocket 102. The pocket 102 is sewn to the insulating panel 103, with one end left open for the insertion of the freezable gel 701. The refreezable gel is that generically referred to as "blue ice" which, once frozen, is used to cool the food or beverage which is held within the invention. Additionally, other cooling means, such as traditional ice or other mechanisms to effect cooling could be utilized in the invention. After the freezable gel 701 is inserted into the pocket 102, the open end is sewn shut, permanently holding the freezable gel 701 in place. The pocket 102 is orientated transverse to the length of the insulating panel 103. The pocket 102 may be composed of the same material as the fabric cover of the insulating panel 103, or in the alternative they may be composed of separate fabric or other material and sewn into position on the fabric cover of the insulating panel 103. The freezable gel 701 is held within a flexible plastic, polyurithane, vinyl or other leak-proof material sack 702.

Figure 8:
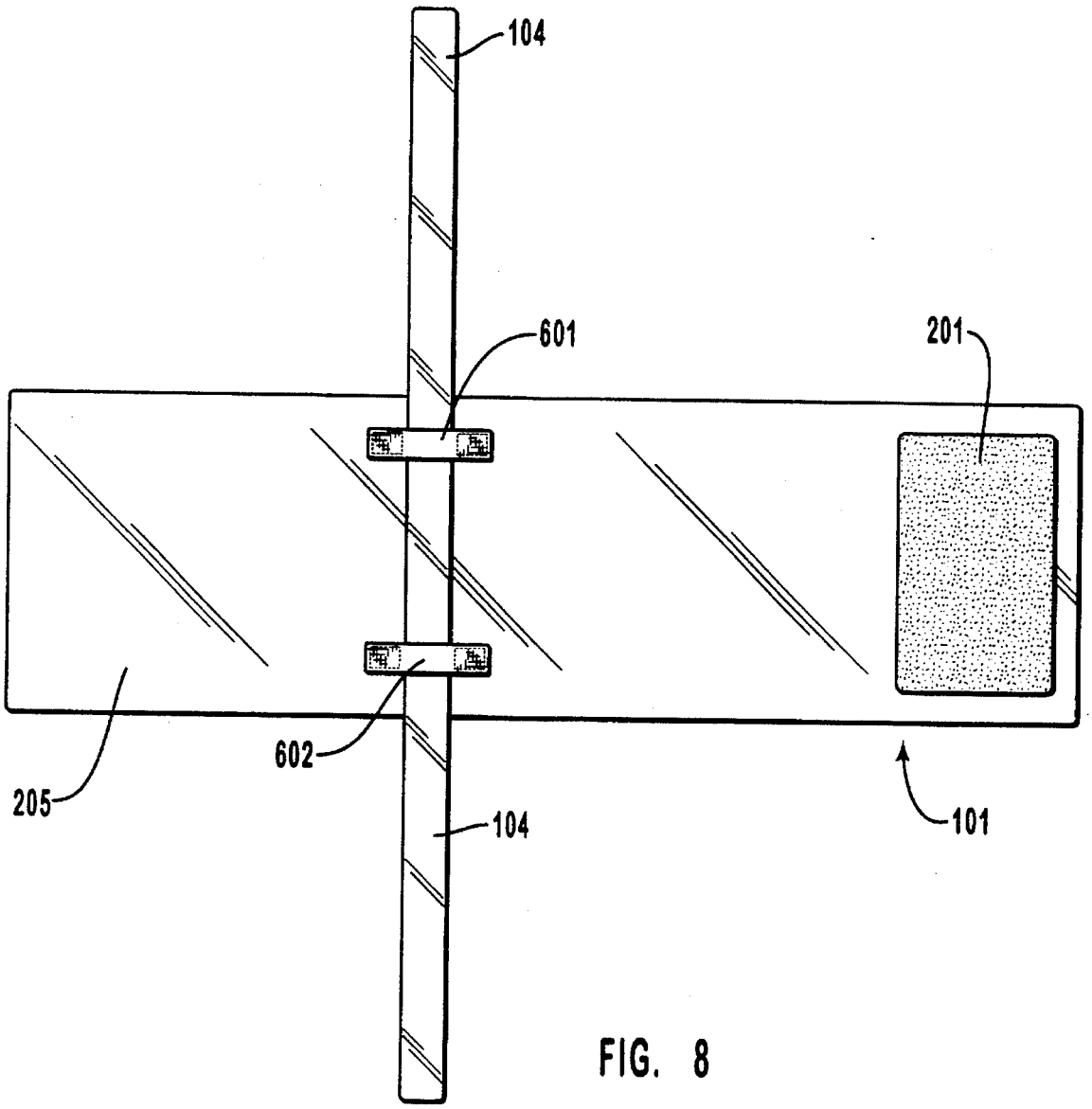
FIG. 8 depicts the back side of the invented cooling pack invention.

FIG. 8 shows the exterior side 205 of the cooling pack 101 from what is depicted in FIG. 1 and more clearly shows the second component of the hook and loop fastener 201 and the loops 601 and 602 used to hold the strap 104 to the cooling pack 101.

The invention is designed to be foldable and adjustable, so as to fit tightly around a variety of different sizes and shapes of food or beverage containers. The invention, in its preferred embodiment, also includes a hook and loop type fastener, positioned on each end of the fabric backed foam rubber portion to act as the means by which the cooling pack is closed around a food or beverage container. Other types of fasteners may also be used, including: snaps, buttons, zippers, belts with buckles, magnetic fixing means and ties with knots. A strap, with a snap closure means, is also attached to the fabric portion, of the panel, to act both as a closure around the end or ends of the food or beverage container and as a carrying handle. Other ways of closing or Joining the ends of the strap may also be employed, including: buttons, pins, knots, clips, and buckles may also be used to connect the ends of the strap.

The foregoing description of the invention so fully reveals the general nature of the invention that others can readily modify such invention and/or adapt it for various applications without departing from its generic concept, and therefore such adaptations and modifications should be and are intended to be comprehended within the meaning and range of equivalents to the following claims which claims define subject matter regarded to be the invention.

We claim:

1. A foldable and adjustable cooling pack for cooling or maintaining cool a containerized food or beverage product, comprising:

(a) a foldable panel section having a first side, a second side, a first end and a second end, to provide support for a container, said foldable panel section being configurable so that it interchangeably tightly conforms to the exterior shape of either generally cylindrically shaped containerized food or beverage product, or a generally polyhedron shaped containerized food or beverage products;

(b) a plurality of pockets attached along said first side of said foldable panel, to provide structural support;

(c) a plurality of cooling elements, held within said plurality of pockets and in such a manner as to provide complete enclosure of said plurality of cooling elements by said plurality of pockets, thereby keeping said plurality of cooling elements from coming into direct physical contact with the containerized food or beverage product and to provide a cooling for the containerized food or beverage product;

(d) a first fastener, attached to said first end of said first side of said foldable panel;

(e) a second fastener, attached along said second side of said foldable panel; and (f) a strap attached to said second side of said foldable panel section, to provide support for the container and to provide a handle for carrying the cooling pack.

2. A foldable and adjustable cooling pack for cooling or maintaining cool a beverage or food product as recited in claim 1, further comprising:

(g) a plurality of attachable panels, for providing insulated coverage around all sides and the top and bottom of generally box shaped containers; and (h) a connector for attaching said plurality of attachable panels to said foldable panel section.

3. A foldable and adjustable cooling pack for cooling or maintaining cool a beverage or food product, comprising:

(a) a foldable panel section having a first side, a second side, a first end and a second end, to provide support for a container, said foldable panel section being configurable so that it interchangeably tightly conforms to the exterior shape of either a generally cylindrically shaped containerized food or beverage product, or a generally polyhedron shaped containerized food or beverage products;

(b) a plurality of pockets attached along said first side of said foldable panel, to provide structural support;

(c) a plurality of cooling elements, held within said plurality of pockets and in such a manner as to provide complete enclosure of said plurality of cooling elements by said plurality of pockets, thereby keeping said plurality of cooling elements from coming into direct physical contact with the containerized food or beverage product and to provide a cooling for the containerized food or beverage product;

(d) a first fastener, attached to said first end of said first side of said foldable panel;

(e) a second fastener, attached along said second side of said foldable panel; and (f) a strap attached to said second side of said foldable panel section, to provide support for the container and to provide a handle for carrying the cooling pack, (g) a plurality of attachable panels, for providing insulated coverage around all sides and the top and bottom of generally box shaped containers; wherein said plurality of attachable panels are composed of an insulating multi-layered material, said multi-layered material comprising:

(i) a first fabric layer, for providing structural support and on which designs or symbols may be printed;

(ii) an insulating layer composed of a thermal insulating material; and (iii) a second fabric layer, for providing structural support and on which designs or symbols may be printed; and (h) a connector for attaching said plurality of attachable panels to said foldable panel section.

4. A foldable and adjustable cooling pack for cooling or maintaining cool a beverage or food product, comprising:

(a) a foldable panel section having a first side, a second side, a first end and a second end, to provide support for a container, said foldable panel section being configurable so that it interchangeably tightly conforms to the exterior shape of either a generally cylindrically shaped containerized food or beverage product, or a generally polyhedron shaped containerized food or beverage products;

(b) a plurality of pockets attached along said first side of said foldable panel, to provide structural support;

(c) a plurality of cooling elements, held within said plurality of pockets and in such a manner as to provide complete enclosure of said plurality of cooling elements by said plurality of pockets, thereby keeping said plurality of cooling elements from coming into direct physical contact with the containerized food or beverage product and to provide a cooling for the containerized food or beverage product;

(d) a first fastener, attached to said first end of said first side of said foldable panel;

(e) a second fastener, attached along said second side of said foldable panel; and (f) a strap attached to said second side of said foldable panel section, to provide support for the container and to provide a handle for carrying the cooling pack;

(g) a plurality of attachable panels, for providing insulated coverage around all sides and the top and bottom of generally box shaped containers; and (h) a connector for attaching said plurality of attachable panels to said foldable panel section, wherein said connector for attaching said plurality of attachable panels comprises a hook and loop-type fastener, affixed to said attachable panels and to said foldable panel section.

5. A foldable and adjustable cooling pack for cooling or maintaining cool a beverage or food product, as recited in claim 1, wherein said foldable panel section is of a generally rectangular shape.

6. A foldable and adjustable cooling pack for cooling or maintaining cool a beverage or food product, as recited in claim 1, wherein said foldable panel section further comprises a flexible multilayered temperature insulating material.

7. A foldable and adjustable cooling pack for cooling or maintaining cool a beverage or food product, as recited in claim 6, wherein said flexible multilayered temperature insulating material further comprises:

(a) a first fabric layer, for providing structural support and on which designs or symbols may be printed;

(b) an insulating layer composed of a thermal insulating material; and (c) a second fabric layer, for providing structural support and on which designs or symbols may be printed.

8. A foldable and adjustable cooling pack for cooling or maintaining cool a beverage or food product, as recited in claim 1, wherein said plurality of pockets is greater than two in number.

9. A foldable and adjustable cooling pack for cooling or maintaining cool a beverage or food product, as recited in claim 1, wherein said plurality of pockets is positioned on said foldable panel section in more than one group of pockets, wherein each said group of pockets is further composed of more than one pocket.

10. A foldable and adjustable cooling pack for cooling or maintaining cool a beverage or food product, as recited in claim 1, wherein said plurality of pockets are positioned transverse across said foldable panel section and in parallel with said first and second end of said foldable panel section.

11. A foldable and adjustable cooling pack for cooling or maintaining cool a beverage or food product, as recited in claim 1, wherein said plurality of pockets are composed of a fabric material.

12. A foldable and adjustable cooling pack for cooling or maintaining cool a beverage or food product, as recited in claim 1, wherein said plurality of pockets are permanently sealed closed with said cooling elements held inside.

13. A foldable and adjustable cooling pack for cooling or maintaining cool a beverage or food product, as recited in claim 1, wherein said plurality of pockets each have an openable end for receiving or withdrawing said cooling element into or from said pockets.

14. A foldable and adjustable cooling pack for cooling or maintaining cool a beverage or food product, as recited in claim 1, wherein said plurality of cooling elements each further comprises a leak proof envelope containing a refreezable gel.

15. A foldable and adjustable cooling pack for cooling or maintaining cool a beverage or food product, as recited in claim 1, wherein said first fastener and said second fastener further comprises a hook and loop-type fastener.

16. A foldable and adjustable cooling pack for cooling or maintaining cool a beverage or food product, as recited in claim 1, wherein said strap further comprises an adjustable snap closure.

17. A means for cooling or maintaining cool a containerized food or beverage product while minimizing the additional space required and while maximizing the flexibility to fit a large variety of food or beverage product containers, comprising:

(a) a means for supporting the weight of the food or beverage product container;

(b) a means for cooling the food or beverage product container;

(c) a means for fastening around the food or beverage product container;

(d) a means for insulating the food or beverage container from outside air to maintain a cool temperature for a maximum amount of time;

(e) a means for configuring said means for cooling or maintaining cool so that it interchangeably tightly conforms to the exterior shape of either a generally cylindrically shaped containerized food or beverage product, or a generally polyhedron shaped containerized food or beverage products; and (f) a means for carrying the food or beverage container.

* * * * *